US005944039A

United States Patent [19]

Bergeron

[11] Patent Number: 5,944,039

[45] Date of Patent: Aug. 31, 1999

[54] BOAT COVER SYSTEM WITH ADJUSTABLE BRACKET DEVICE

[76] Inventor: David R. Bergeron, 222 Kate Ln., Tolland, Conn. 06084

[21] Appl. No.: 09/021,653

[22] Filed: Feb. 10, 1998

[51] Int. Cl.[6] ..... Z04H 15/64; B63B 17/04

[52] U.S. Cl. ..... 135/119; 135/88.04; 135/123; 135/907; 114/361; 248/278.1; 403/97; 403/146; 296/104; 296/100.15

[58] Field of Search ..... 135/119, 906, 135/907, 121–123, 152–153, 88.04, 88.01; 114/361; 248/230.1, 291.1, 292.1, 278.1; 403/97, 99, 146, 113; 296/100.14, 100.15, 100.18, 104

[56] References Cited

U.S. PATENT DOCUMENTS

| | | | |
|---|---|---|---|
| 369,971 | 9/1887 | Stillman | 248/278.1 X |
| 611,190 | 9/1898 | Abernathy | 248/278.1 X |
| 811,322 | 1/1906 | Poltock | 135/119 X |
| 970,751 | 9/1910 | Pranke | 403/97 X |
| 1,114,921 | 10/1914 | Selstad | 248/278.1 X |
| 1,706,215 | 3/1929 | Davidson | 403/97 X |
| 2,512,764 | 7/1950 | Vonder Ahe | 135/6 |
| 3,604,440 | 9/1971 | Wilson | 135/6 |
| 4,075,723 | 2/1978 | Bareis et al. | 9/1.5 |
| 4,480,652 | 11/1984 | Gooch | 135/88 |
| 4,671,203 | 6/1987 | Sanburg | 114/361 |
| 4,926,782 | 5/1990 | Lacy | 114/361 |
| 4,979,456 | 12/1990 | Steward | 114/351 |
| 5,009,184 | 4/1991 | Voldrich | 114/361 |
| 5,070,807 | 12/1991 | Lewis | 114/361 |
| 5,413,063 | 5/1995 | King | 114/221 R |
| 5,579,797 | 12/1996 | Rogers | 135/90 |

*Primary Examiner*—Carl D. Friedman
*Assistant Examiner*—Winnie Yip
*Attorney, Agent, or Firm*—Alix, Yale & Ristas, LLP

[57] ABSTRACT

This invention is a boat covering system with adjustable bracket devices clamped to the outer stanchions of a boat. Flexible support ribs extend across the boat and are inserted into the pair of brackets located on opposite sides of the boat. These flexible support ribs form the main framework for the boat cover. The brackets are adjustable around a plurality of axes for adjustability of the overall cover height and configuration.

6 Claims, 3 Drawing Sheets

BOAT COVER SYSTEM WITH ADJUSTABLE BRACKET DEVICE

FIELD OF THE INVENTION

This invention relates to a boat covering system and most specifically to adjustable brackets which are designed to clamp around the stanchions of a boat for mounting the covering system.

BACKGROUND OF THE INVENTION

A variety of boat covering methods have been employed in the boating industry. Those boat covering methods are often difficult to construct and attach to the boats and to adjust to provide the proper covering framework.

SUMMARY OF THE INVENTION

The present invention relates to a boat covering system which employs adjustable brackets which easily fasten to the boat stanchions and which are adjustable in two directions. The brackets are composed of three main parts interconnecting as one mechanism. A split clamp allows for clamping to the boat stanchions while an adjustable side clamp arm allows for rotation in fore and aft direction. An upper adjustable clamp arm allows for rotation in the lateral (side to side) direction across the boat. Means are provided in the brackets for attaching flexible support ribs which extend across the boat to support the cover.

DETAILED DESCRIPTION OF THE INVENTION

Figure 1:
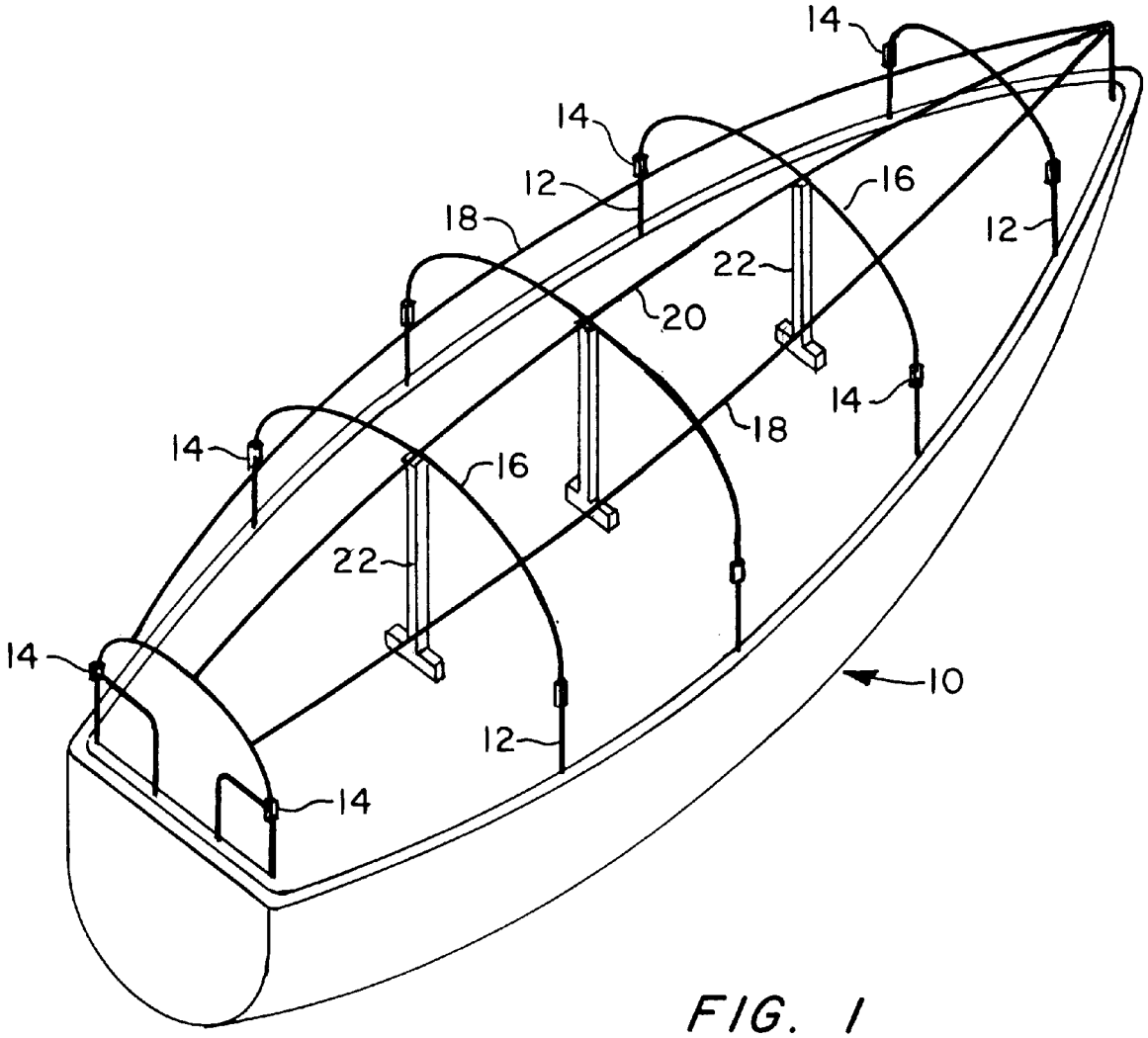
FIG. 1 is a general arrangement of the boat covering system of the present invention utilizing the adjustable brackets.

FIG. 1 is a general arrangement drawing which illustrates a boat 10 with stanchions 12 which are attached around the outer periphery. The stanchions 12 support the lifelines extending around the deck which have been omitted from the drawing for purposes of clarity. The main components of the boat covering system comprise the adjustable brackets 14, and the lateral flexible support ribs 16 with their ends inserted into the adjustable bracket 14 and which are flexed over the boat. These lateral flexible support ribs 16 extend between each pair of stanchions 12 on opposite sides of the boat that have adjustable brackets 14. Flexible longitudinally extending side support ribs 18 and center support rib 20 are attached to the lateral flexible support ribs 16 such as by clamping or taping. Although only one side support rib 18 has been shown on each side of the boat, the boat width may dictate that additional side support ribs 18 are needed for adequate support of the cover. For additional support, the support stands 22, made of wood or other suitable material, are located under at least some of the intersection points between the center support rib 20 and the lateral support ribs 16. The number of support stands 22 and their position will vary depending on the size of the boat. Once the main frame structure is complete, a cover of a durable plastic or other suitable cover material is placed over the frame and securely tied down.

Figure 2:
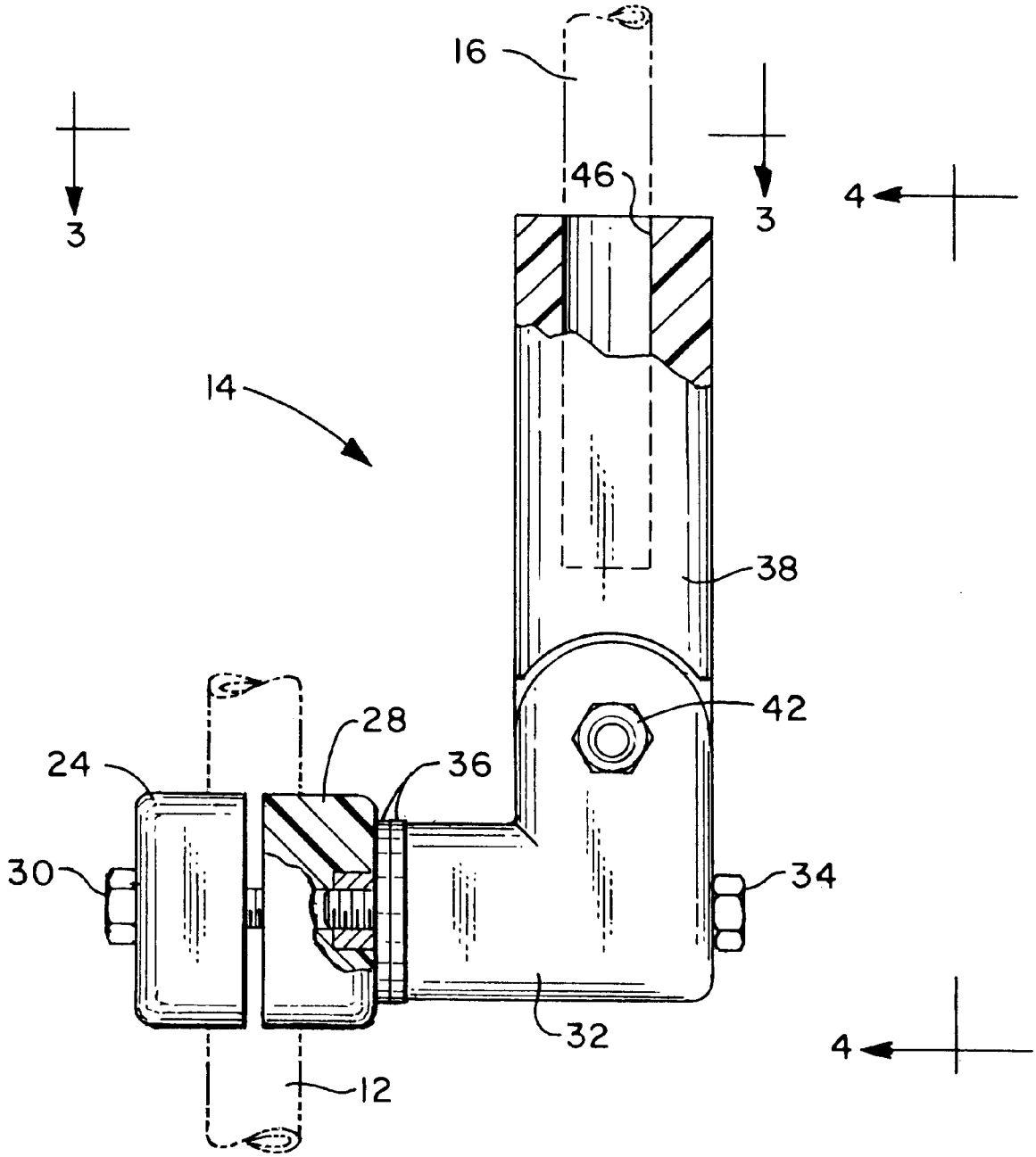
FIG. 2 is a side view of the adjustable bracket.
Figure 3:
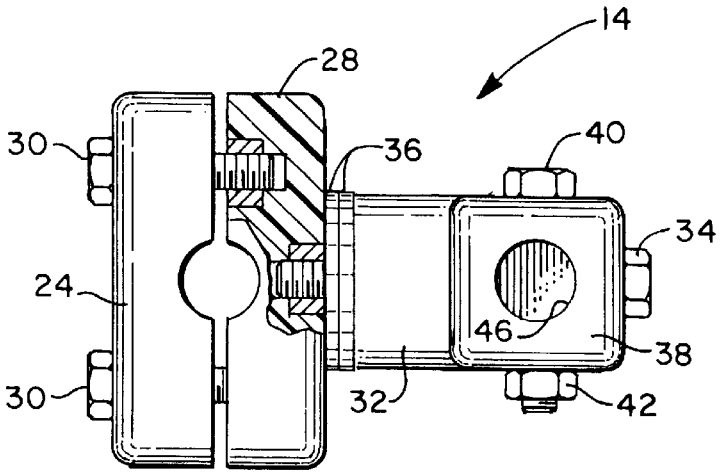
FIG. 3 is a top view of the adjustable bracket.
Figure 4:
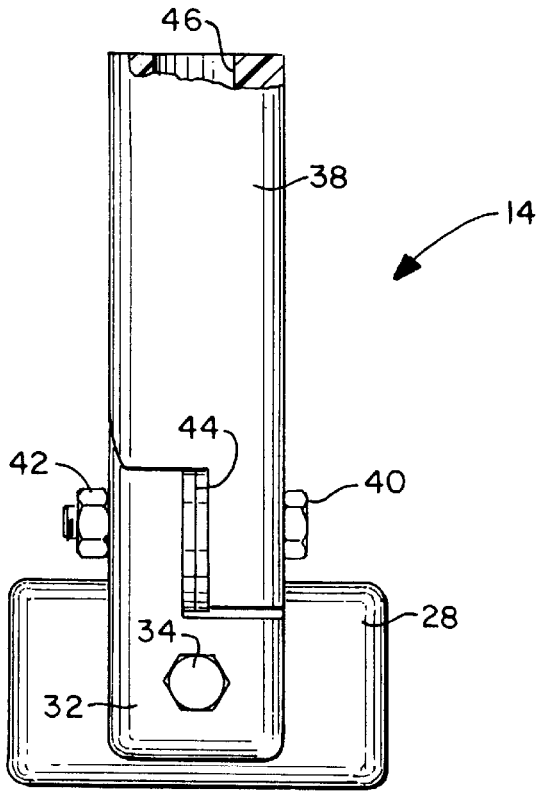
FIG. 4 is a front view of the adjustable bracket.

The principle component of the invention is the adjustable bracket 14 as shown in detail in FIGS. 2 to 4. Each adjustable bracket 14 is fastened to a boat stanchion 12 via a split clamp 24 formed of the two pieces 26 and 28. The split clamp 24 is tightened together around a boat stanchion 12 via two thru bolts 30 (as clearly depicted in FIG. 3) or which may have tightening knobs.

For fore and aft movement, an adjustable side clamp arm 32 allows for angular adjustments during the initial installation stages of the main framework system. A single thru bolt 34 which may have a tightening knob provides tightening of the adjustable side clamp arm 32 to the split clamp 24. To prevent slippage of the adjustable side clamp arm 32, a gear tooth locking mechanism 36 is provided as part of the split clamp 24 and adjustable side clamp arm 32. The two gear teeth parts easily engage and disengage from each other allowing for a solid locking mechanism between the split clamp 24 and the adjustable side clamp arm 32.

For angular adjustment of the bracket in the lateral, side to side direction across the boat, an upper adjustable clamp arm 38 is provided. The flexible ribs 16 are inserted into these clamp arms 38 as shown in FIG. 1. The rotation of the upper adjustable clamp arm 38 changes the angle between the ribs 16 and the stanchions 12. This allows for height adjustments of the main frame system during the installation stages. The angle setting of the upper adjustable clamp arm 38 depends upon the overall cabin height of a boat. A single thru bolt 40 with nut 42 as depicted in FIG. 4 or knob tightening mechanism provides tightening of the upper adjustable clamp arm 38 to the adjustable side clamp arm 32. To prevent slippage of the upper adjustable clamp arm 38, a gear tooth locking mechanism 44 is provided as part of the adjustable side clamp arm 32 and upper adjustable clamp arm 38. The two gear teeth parts are easily engaged and disengaged from each other allowing for a solid locking mechanism between the adjustable side clamp arm 32 and upper adjustable clamp arm 38. To allow for the insertion of a flexible rib 16 as shown in FIG. 1, an opening 46 is provided as part of the upper adjustable clamp arm 38.

The improved boat cover system of this invention enables a boat to be covered quickly with the use of adjustable brackets that make the installation easier and can be finally adjusted to conform perfectly to a particular boat. The adjustable brackets are readily adjustable for fitting a variety of boats. The simple design of this invention ensures consistency and also assures quick and easy installation every year. There is no more need for wood or metal frames that are tedious or frustrating to install.

What is claimed is:

1. A boat covering system for attachment to boat stanchions comprising a plurality of pairs of adjustable brackets for attachment to stanchions on opposite sides of a boat and a plurality of flexible ribs extending between said plurality of pairs of adjustable brackets for supporting a cover over a boat; said adjustable brackets each comprising:

i) clamp means for attaching said bracket to a stanchion in a desired position, ii) a first arm rotatably attached to said clamp means about a horizontal axis extending in a first direction and including means for locking said first arm in a desired position relative to said clamp means, and iii) a second arm rotatably attached to and extending upwardly from said first arm about a horizontal axis perpendicular to said first direction and including means for locking said second arm in a desired position relative to said first arm, said second arm including means for attaching said flexible ribs.

2. A boat covering system as recited in claim 1 wherein said clamp means comprises a split clamp adapted to fit around a stanchion and bolt means for tightening said split clamp to the stanchion.

3. A boat covering system as recited in claim 1 wherein said first arm and said second arm are rotatably attached by bolt means which form said horizontal axes and wherein said means for locking said first arm and said second arm comprises a locking mechanism locked together by said bolt means.

4. A boat covering system as recited in claim 1 wherein said first direction is laterally across the boat and said second direction is longitudinally fore and aft of the boat.

5. A boat covering system as recited in claim 4 and further including at least one flexible support member extending longitudinally and attached to said flexible ribs.

6. A boat covering system as recited in claim 1 and further including vertical support members supporting said flexible ribs between said brackets.

* * * * *